US006297462B1

(12) United States Patent
Johnston et al.

(10) Patent No.: US 6,297,462 B1
(45) **Date of Patent: *Oct. 2, 2001**

(54) ROTARY MATRIX SWITCH

(75) Inventors: Timothy P. Johnston, Los Gatos, CA (US); Dana J. Koppes, Columbus, OH (US); Gary T. Brint, Scott's Valley; Jeffrey P. Stram, Santa Cruz, both of CA (US)

(73) Assignee: Plantronics, Inc., Santa Cruz, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/233,289

(22) Filed: Jan. 19, 1999

(51) Int. Cl.[7] ..... H01H 19/62
(52) U.S. Cl. ..... 200/6 BB; 200/116; 200/14
(58) Field of Search ..... 200/14, 116, 6 BB, 200/6 C, 51.04, 51.06, 43.06

(56) References Cited

U.S. PATENT DOCUMENTS 414,922 * 11/1889 Rodman, Jr. ..... 200/51.06
2,960,580 * 11/1960 Aquillon ..... 200/6 BB
4,051,349 * 9/1977 Englund ..... 200/43.06 X
4,071,720 * 1/1978 Krajci et al. ..... 200/6 BB X
4,647,734 * 3/1987 Dana ..... 200/43.06
4,803,313 * 2/1989 Rolf ..... 200/6 BB

* cited by examiner

*Primary Examiner*—Renee Luebke
(74) *Attorney, Agent, or Firm*—Fenwick & West LLP

(57) ABSTRACT

A rotary matrix switch allows arbitrary selection from among different electrical connection configurations between m input terminals and n output terminals by rotation of a shaft or dial. A rotary shaft has a plurality of contact mechanisms at spaced locations and angular positions. The locations of the contact mechanisms correspond to individual contacts between the input and output terminals. The contact mechanisms may be lobes, indentations, conductive strips, or the like. Rotation of the shaft selectively engages ones of the contact mechanism to connect electrically various input and output terminals. The rotary shaft is removable to allow for the ability to make field upgrades and provide new configurations of connections. One embodiment of the invention can function as a telephone headset adapter, wherein rotation of a shaft allows the user to choose easily from among different handset port wiring configurations.

11 Claims, 5 Drawing Sheets

ROTARY MATRIX SWITCH

BACKGROUND

1. Field of the Invention

The present invention relates in general to apparatus for electrical switching between arbitrary numbers of input and output terminals, and in particular to the field of telephone headset adapters and the wiring configuration switching for compatibility with the various handset port interfaces.

2. Background of the Invention

In order to interface properly a telephone to a headset, a telephone headset adapter must correctly match the transmit and receive lines of the handset to the transmit and receive lines of the headset. To obtain broad product acceptance, the telephone headset adapter must be compatible with a large variety of telephones. However, a major problem in providing a telephone headset adapter that is compatible with most telephones is the lack of industry standards for handset port wiring. Most telephones use a four pin modular connector to plug in the handset. However, pin assignment for these four pins is not standardized. In addition, some manufacturers use a three wire interface with the fourth pin providing power for handset electronic systems.

Traditionally the connection between the headset and handset has often been achieved using either multi-pole bit switches or combinations of readily available, or custom built, slide switches. These solutions thus require the use of "codes" or switch setting combinations which are non-intuitive to the end user. The switches are typically small and difficult to manipulate with one's fingers, thus making it difficult for the user to configure correctly the telephone headset adapter. Furthermore, if the "code" is lost, misplaced, or unknown, the user has little recourse but to try different switch position combinations, cycling systematically through the different possibilities. For the average user this might be difficult to do. Clearly it would be advantageous for the user to be able to cycle quickly and easily through a range of possible combinations or configurations.

Another drawback is that most of the traditional switch solutions are only dedicated to a subset of possible combinations of handset and headset connections. As a result, when a new telephone wiring combination is needed for a new telephone a complete product redesign of the telephone headset adapter is required to adapt to the new wiring configuration.

Other traditional solutions include a silicon "crosspoint" switch chip that can connect any one of (typically) four input lines with any one of (typically) four output lines. This solution suffers from the drawback that extensive protection circuitry is required to prevent damage to the crosspoint switch from line voltages, RF interference and ESD events. Furthermore, if isolation between the telephone and the adapter system is required, power from the adapter system must be provided to the isolated telephone interface section of the circuit. This requires extra cost. Clearly it would be more cost effective to have an adapter system which is isolated from the telephone and which has a passive telephone interface section.

SUMMARY OF THE INVENTION

The present invention provides apparatuses for arbitrarily electrically connecting m input terminals with n output terminals with the use of a rotary matrix switch. Each apparatus can be used to connect some or all of the m input terminals with some or all of the n output terminals, leaving the remaining input terminals disconnected from the output terminals. A terminal can be, for example, a device to which a wire or a cable can be attached, or, for another example, merely an electrical junction that can be used to connect electrically a device with another device. One such apparatus for effecting arbitrary electrical connection comprises an assembly housing the m input and n output terminals, a number of electrical connectors (such as electrical spring contacts, for example) for connecting a number of the input terminals with a number of the output terminals, and a second assembly housing a rotary shaft having one or more contact mechanisms which can rotate with the shaft to engage or disengage selected ones of the electrical connectors. As the user rotates the rotary shaft, various ones of the contact mechanisms couple to selected predetermined ones of the electrical connectors, and thereby the apparatus cycles through various electrical connection configurations between the input and output terminals in a continuous and straightforward manner.

One embodiment finds use as an interface adapter between a telephone and a headset, thereby allowing the user easily to choose from among different possible handset wiring configurations.

The contact mechanisms can take a variety of different forms. For example, the contact mechanisms may be lobes, strips of electrically conductive material, indentations or depressions, or any other mechanism coupled to the rotary shaft which can mechanically or electrically engage two separated electrical connectors in response to rotation of a rotary shaft.

Further, the housing for the rotary shaft can be of monolithic construction, enabling easy assembly. The combined housing and shaft can be constructed so as to allow easy removal and replacement of the shaft should new wiring configurations dictate, thereby allowing for an unlimited number of configurations. This enables the shaft to be replaced with a new shaft by the user, thereby making the making field-upgrading of the apparatus, for example a telephone adapter, relatively quick and easy.

DETAILED DESCRIPTION OF THE PREFERRED EMBODIMENT

Figure 1:
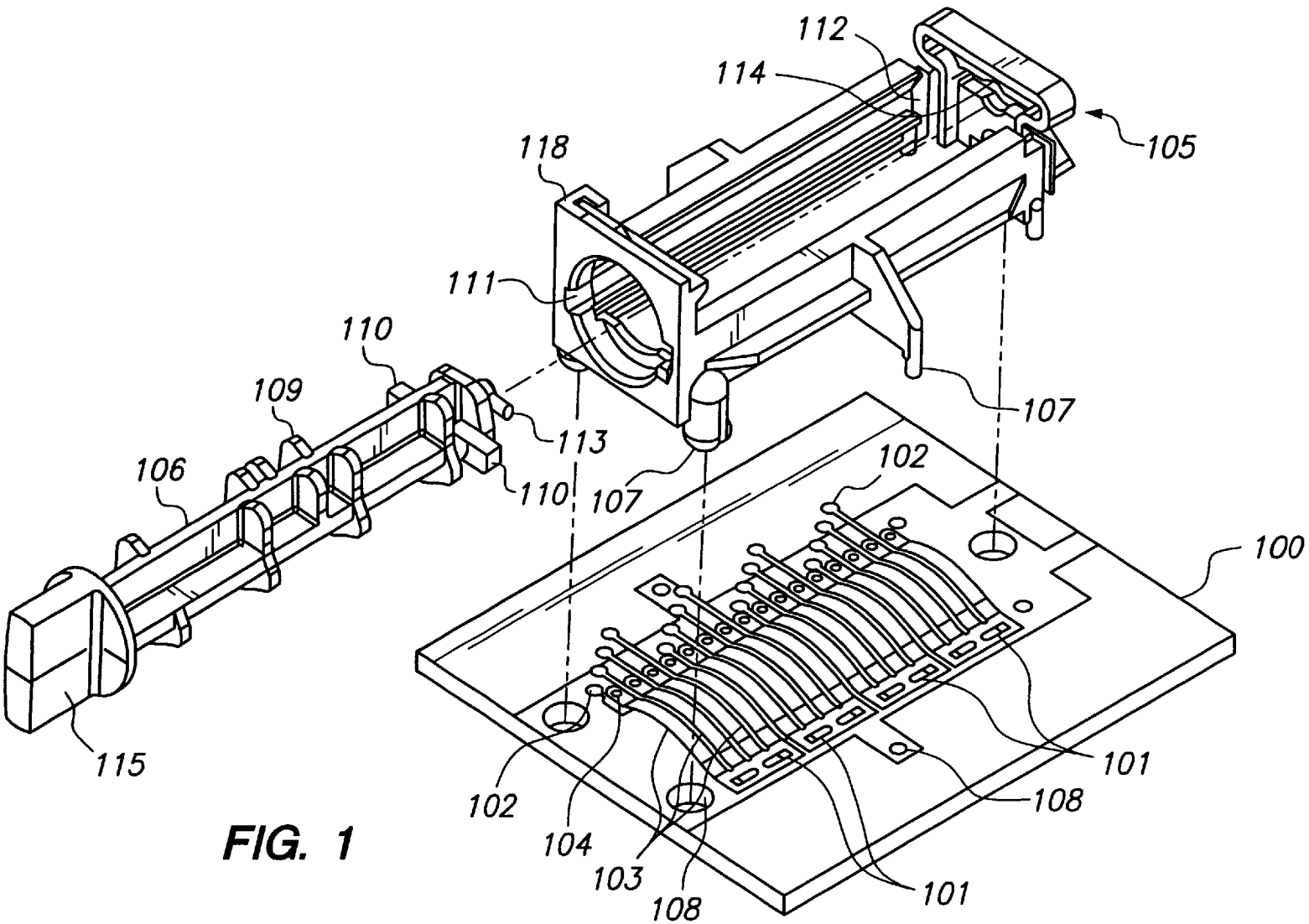
FIG. 1 is an isometric drawing showing two assemblies, and a rotary shaft, of a rotary matrix switch apparatus.

FIG. 1 is an isometric drawing of one embodiment of the present invention. A first base assembly 100, made of an electrically insulating material pad, such as plastic, houses four input terminals 101 and sixteen output terminals 102. In this embodiment the four input terminals are in the form of four separated electrically conducting strips of material arranged sequentially along a first line on the pad. From each of the four input terminals 101 are electrically connected and project four equal length arcuate strips 103 of electrically conducting material. Each strip 103 is arced so that the free end, not fixed to the input terminals 101, is raised above and not in electrical contact with part of one of the sixteen output terminals 102, and so that if a base-directed force is applied to the strip 103, the strip swings about the fixed end, toward the pad, so as to touch and come into electrical contact with one of the output terminals 102. If the force is subsequently removed the strip 103 moves away from, and thus electrically disconnects from, the output terminal 102. The strip 103 thus functions as an electrical spring contact. The free end of each of the strips 103 is bent to form a contact area 104. Thus the strip 103 can come into solid electrical contact with one of the output terminals 102. Those skilled in the art will recognize that the electrically conducting strips 103 need not be arcuate: this feature of the embodiment shown in FIG. 1 does, however, provide the advantage of displaying a greater restorative force against a displacing lobe. Straight strips, for example, might also be used.

In each of the apparatuses there are n output terminals. In the embodiment shown in FIG. 1 there are sixteen output terminals 102 in the form of sixteen separated electrically conducting strips of material arranged sequentially along a second line which is parallel to the first line. The exact shape of the sixteen output terminals is not important. In general it may depend on the use intended for the switch. For example, for some uses one can envisage output terminals 102 possessing an electrical linkage through the base assembly 100, rather than lying on the base assembly 100 as shown in FIG. 1. In the embodiment shown in FIG. 1 one end of each output terminal 102 is approximately the same size and shape as one of the bent free ends 104 of the strips 103, so that efficient electrical contact is made when the strip 103 swings down to make contact with the output terminal 102. The other end of the output terminal 102 juts out and cannot come into physical contact with the strip 103. This permits a wire to be soldered to the other end.

The rotary matrix switch functions as a switch between input and output terminals. One skilled in the art will recognize however that the notion of input and output terminals may be interchanged uniformly throughout without loss of generality. Use of the word "terminal" suggests electrical connection with some external device. In the embodiment shown in FIG. 1 each of the four input terminals 101 and each of the sixteen output terminals 102 is such that it can be electrically connected to a different wire. In the case of the output terminals 102 the electrical wire connection will occur at the end of the terminal that does not come into contact with the strip 103, as described above. Further, for an application of a preferred embodiment to the field of telephone headset adapters (where four input wires are to be configured to connect with four output wires), the output terminals 102 corresponding to the first strip 103, on each input terminal strip 101, will be electrically connected to the same wire, as will those corresponding, respectively, to the second, third, and fourth strips 103 on each input terminal strip 102. This will effectively allow the rotary matrix switch to arbitrarily electrically connect any of the four input terminals 101 to any of the four output terminal wires.

Figure 5A:
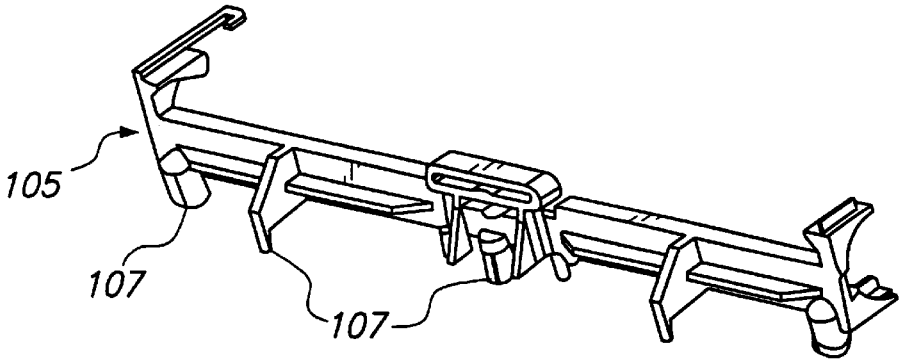
FIGS. 5*a*, 5*b*, & 5*c* present two plan views and one isometric view of a possible monolithic manufacture for a rotary shaft housing assembly.
Figure 5B:
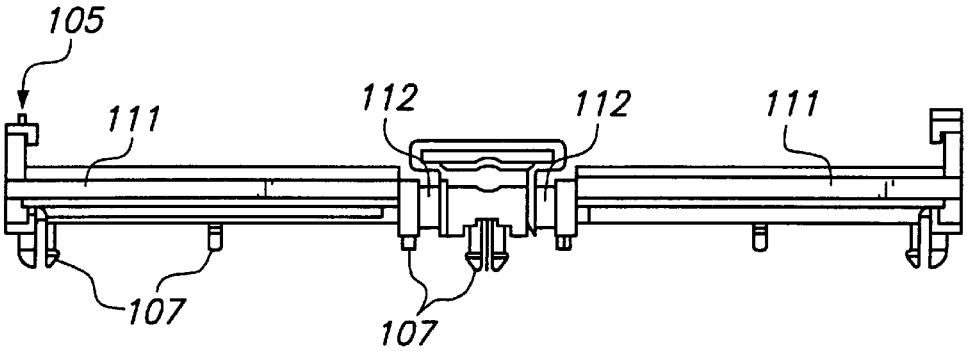
Figure 5C:
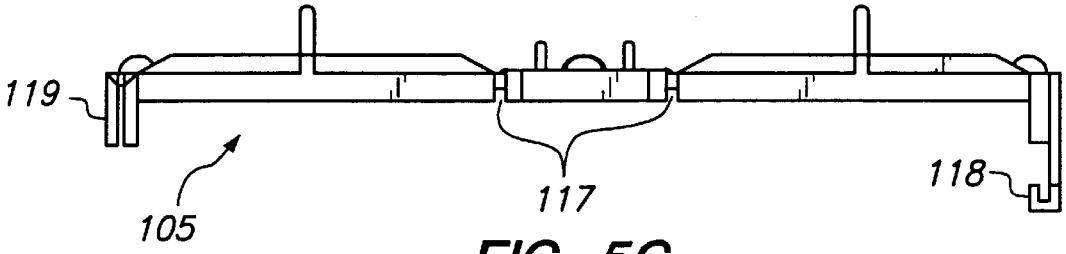

Also shown in FIG. 1 is a second assembly 105 housing a rotary shaft 106, both of which are made of electrically insulating material. The second assembly has a number of convex anchor tabs 107 which can fit into concave slots 108 in the first assembly 100 so as to bring the second assembly 105 into secure physical contact with the first assembly 100. A possible manufacture for the second assembly 105 is shown in different views in FIGS. 5*a*, 5*b*, & 5*c*, and will be described below. The various anchor tabs 107 are also shown in FIGS. 5*a*, 5*b*, & 5*c*.

Figure 4A:
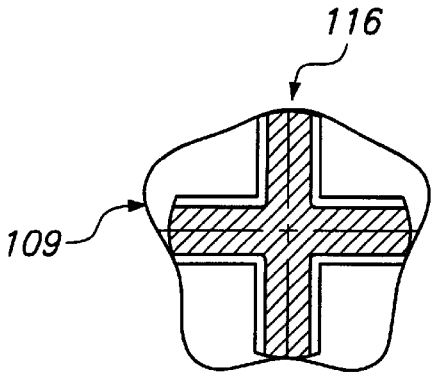
FIGS. 4*a*–4*b* are two cross sectional views of a rotary shaft, with certain details omitted for ease of understanding.
Figure 4B:
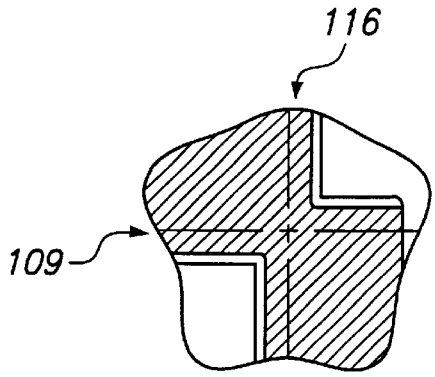

The rotary shaft 106, when housed in the second assembly 105, is fixed so that its only motion in general is to rotate about its longitudinal axis. The shaft has a number of contact mechanisms which selectively engage or disengage the strips 103 in response to rotation of the rotary shaft 106. In this embodiment, the contact mechanisms are lobes 109 projecting out from the axis of the shaft 106. The lobes 109 are positioned at various angular positions around the circumference of the shaft 106, and at various distances along the length of the shaft 106. The width of a lobe 109 is approximately that of one of the strips 103. The lobes 109 are also shown in FIGS. 3*a*, 3*b*, 4*a*, & 4*b*. FIGS. 4*a* & 4*b* provides cross sectional views through the rotary shaft 106 at two different distances along the shaft: through the shaft 106 at a distance where two lobes 109 project in different directions (FIG. 4*b*), and through the shaft 106 at a distance where there are no lobes (FIG. 4*a*). For simplicity the lugs 110 and the circular base of the dial 115 are not indicated in FIGS. 4*a* & 4*b*. Note in FIGS. 4*a* & 4*b* that the bulge 116 does not project from the shaft axis as much as does a lobe 109. Each lobe 109 functions so that, as the shaft 106 rotates through various angular positions, the lobe 109 turns first to come into contact with and then away from exactly one of the strips 103. During the time the lobe 109 is in contact with a strip 103 the lobe 109 exerts a force on the strip 103 so as to cause the strip 103 to swing towards and come into contact with the corresponding output terminal 102 on the base pad 100. With the strip 103 thereby engaged, the corresponding input 101 and output terminals 102 become electrically connected. Further rotation of the shaft 106 causes the lobe 109 to disconnect from the strip 103. The strip 103 thus moves away from the output terminal 102, thereby disengaging, and electrically disconnects the corresponding input and output terminals. Note from FIGS. 4*a* & 4*b* that, as the shaft 106 rotates, the bulge 116 will swing by its corresponding strip 103 and not engage it. Note also from FIGS. 4*a* & 4*b* that in the embodiment shown there can be at most four lobes 109 (as well as a bulge 116) on any cam. Thus, in the embodiment shown there will be four different connection configurations between the input terminals 101 and output terminals 102, each associated with a particular angular position of the shaft. Those skilled in the art will recognize that it is possible to construct and use a rotary shaft 106 with varying maximal numbers of lobes 109 on any cam, thereby correspondingly varying the number of different connection configurations between input terminals 101 and output terminals 102.

The shaft 106 and second assembly 105 are constructed so that in at least one angular position of the shaft 106 the shaft is removable from the second assembly 105. Referring to FIG. 1, in one embodiment this feature is provided by two tracking lugs 110, projecting from the shaft, which permit the shaft to track easily in and out of the second assembly along guide tracks 111 in the second assembly. The tracking lugs 110 and tracks 111 in the second assembly 105 are such that, when the shaft 106 is fully housed in the second assembly 105, the tracking lugs 110 no longer sit in and are guided by the tracks 111, but rather are free to move, with the rotation of the shaft 106, in the wells 112 in the second assembly 105. As the shaft 106 is slid along the guide tracks 111 so as to be fully housed in the second assembly 105, the locking lugs 113, which also project from the shaft 106, pass through the keyhole opening 114. When the shaft 106 is fully housed in the second assembly 105 it can only be removed if the locking lugs 113 are aligned so as to pass through the keyholes 114. There may be one or more orientations of the shaft 106 for which the locking lugs 113 are so aligned. The rotary shaft 106 is constructed so that, for at least one such orientation, none of the lobes 109 are in contact with any of the strips 103. As shown in FIGS. 4*a* & 4*b*, when this occurs, each bulge 116 is at or near its point of closest approach to the strips 103. With the lobes 109 and strips 103 thereby not in contact, the rotary shaft 106 can thereby be easily removed from the assembly 105 without damaging either the lobes 109 or the strips 103. This allows quick and easy replacement of the shaft 106 with another similar shaft, having different lobe positionings, should circumstances dictate. This feature is useful if the desired input-output connections cannot be effected by the housed rotary shaft, and thus a new shaft with the proper lobes may be easily installed. For example, this situation may obtain where the rotary matrix switch is used in a telephone headset adapter, if new telephones, requiring new handset port wiring configurations, enter the market, and upgrading of the headset adapter is desired without redesign of its circuitry.

Figure 8:
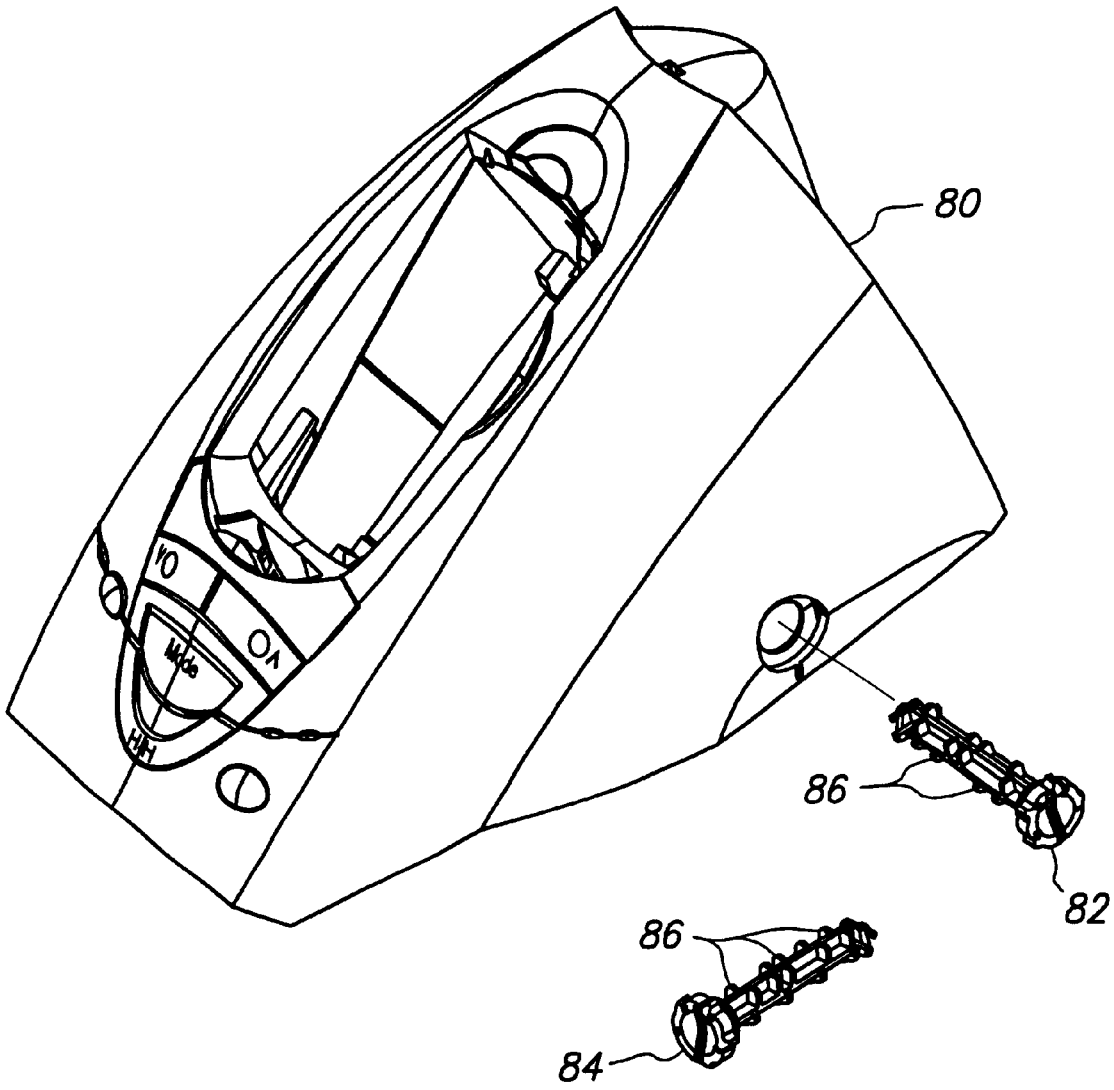
FIG. 8 illustrates a telephone headset adapter with a first rotary shaft, and a second, different rotary shaft.

FIG. 8 illustrates this example, showing a telephone headset adapter 80 and first rotary shaft 82 and second rotary shaft 84. The shafts have different configurations of lobes 86, each shaft thus providing a different set of handset port wiring configurations when coupled with the second assembly (internal to the headset adapter 80).

At the opposite end of the shaft 106 from the locking lugs is the dial 115, which facilitates manual rotation of the shaft 106.

Figure 2:
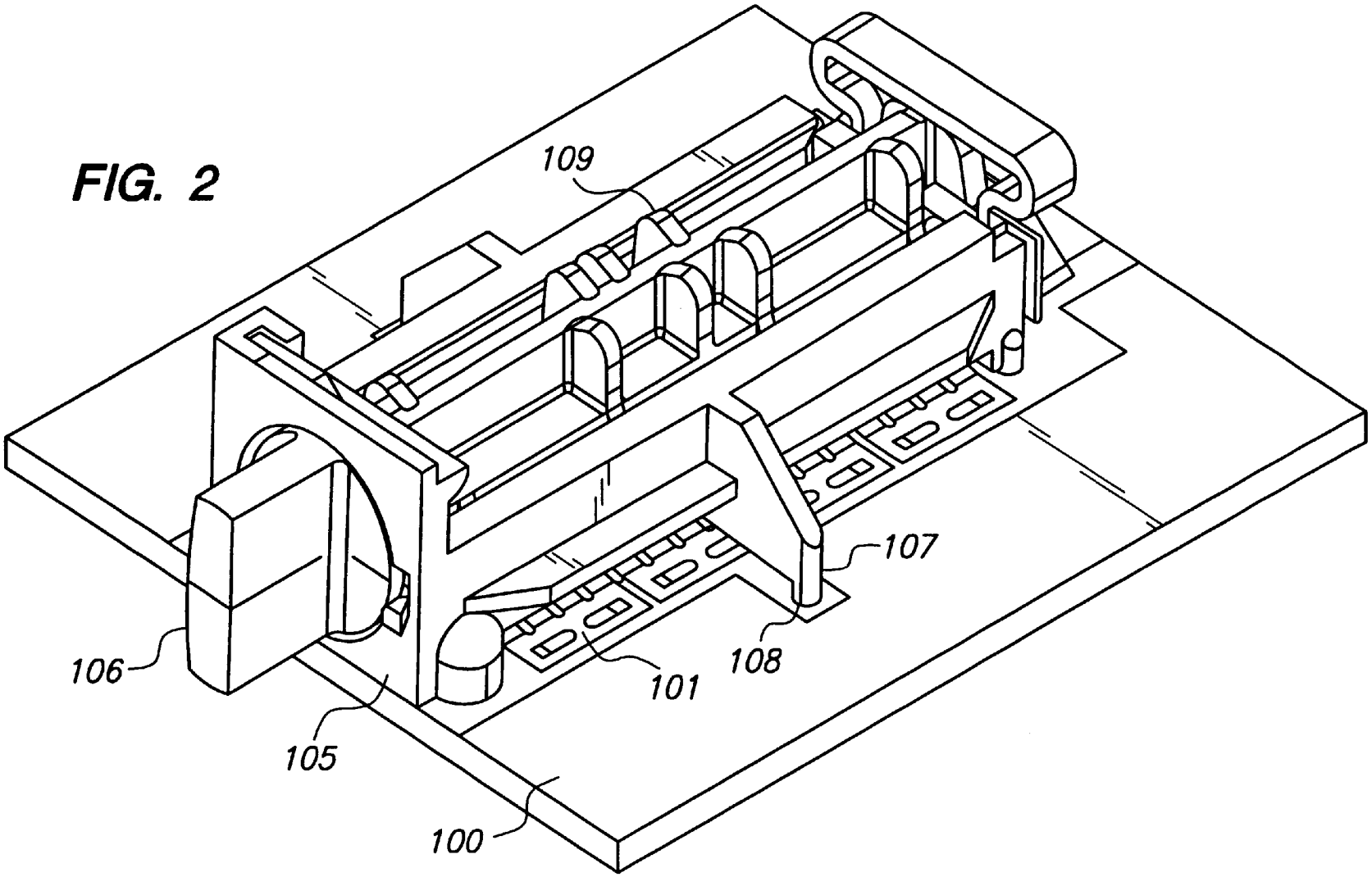
FIG. 2 is an isometric drawing showing assembled apparatus, with a rotary shaft housed in a second assembly, and the second assembly connected to a first assembly.
Figure 3B:
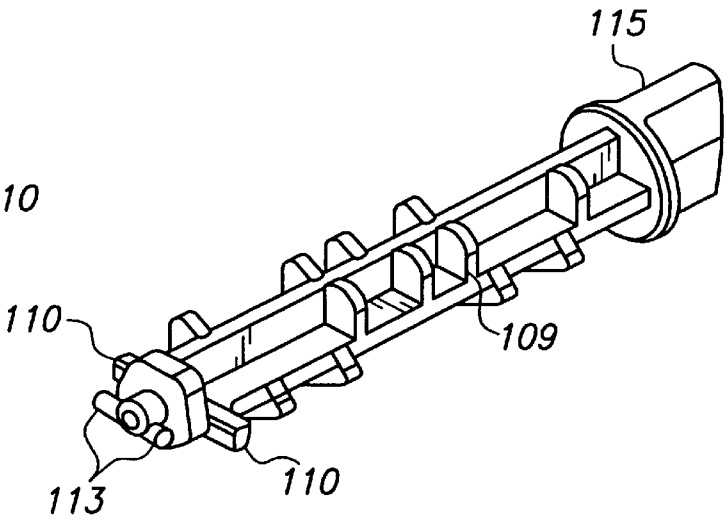
FIGS. 3*a* and 3*b* are isometric drawings showing a rotary shaft from its different ends.
Figure 3A:
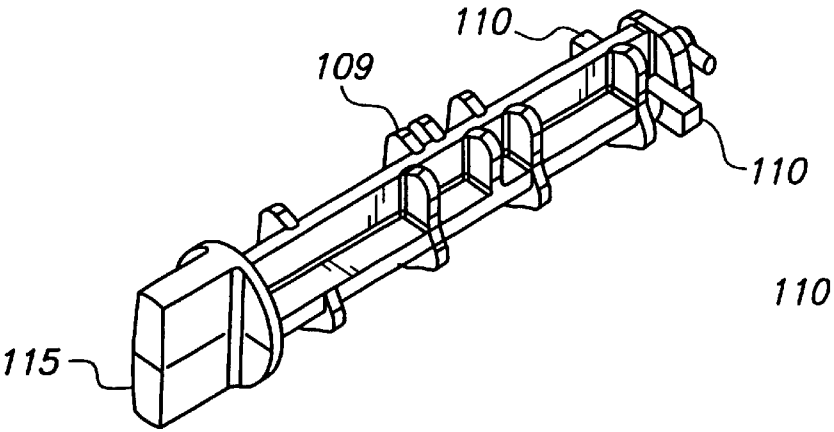

FIG. 2 is an isometric drawing of the assembled apparatus, showing the rotary shaft 106 fully housed in the second assembly 105, which is in turn in secure physical contact with the first assembly 100, as described above.

FIGS. 5*a*, 5*b*, & 5*c* show two plan and one isometric views of a possible monolithic manufacture for the rotary shaft housing second assembly 105 shown in FIG. 1. FIG. 5*b* shows the various anchor tabs 107, as well as the guide tracks 111 and wells 112 shown in FIG. 1. The monolithic manufacture of the second assembly 105 offers ease of manufacture, for example, using 2-part injection molding. Assembly into the second assembly is effected by swinging the end 118, shown in the plan view in FIG. 5*c,* toward the end 119 so that the various segments of the second assembly 105 pivot about the two hinges 117, and hooking end 118 in place around end 119. FIG. 1 shows an isometric view of end 119 so hooked into place. As a result, the entire rotary switch apparatus may be manufactured with just three basic parts: the first base assembly, the shaft, and the second housing assembly. This further reduces the product cost and simplifies the manufactory process.

Figure 6:
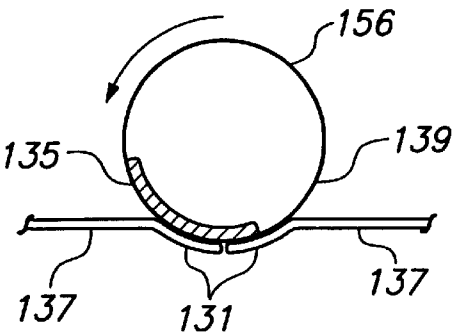
FIG. 6 is a cross sectional view of another embodiment of the rotary shaft.

FIG. 6 illustrates a cross-sectional view of another embodiment of the present invention. Here, rotary shaft 156 has one or more curved contact mechanisms 139, each of which has a strip 135 of electrically conductive material bonded to portion of its perimeter. A simple to manufacture version of this embodiment would be a rotary shaft 156 with a cylindrical surface, with various strips 135 of electrically conductive material placed at various locations and angular positions along the length of the shaft Adjacent the shaft 156 ate two electrical connectors 137, which couple to respective input 101 and output terminals 104. The ends 131 of the connectors are curved to match the curvature of the contact mechanism 139, and are separated by a gap between them. As the rotary shaft 156 is rotated through various angular positions, the strip 135 will come into contact with both ends of the pair of connectors 137, completing the electrical connection and engaging the input and output terminals.

Figure 7B:
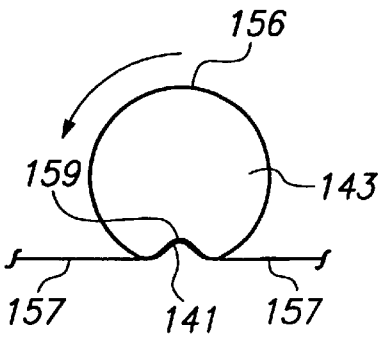
FIGS. 7*a* and 7*b* illustrate an alternate embodiment of the contact mechanisms.
Figure 7A:
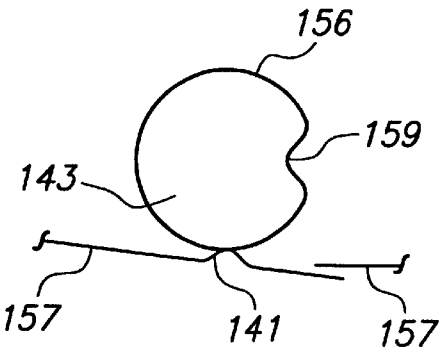

FIGS. 7*a* and 7*b* illustrate yet another embodiment of the contact mechanisms within the scope of the present invention. Here, instead of using lobes to engage the connectors, as in the embodiment of FIG. 1 a lobe 143 disengages connectors, and an indentation 159 is used to engage the connectors. More specifically, the rotary shaft 156 has a substantially circular lobe 143 with one or more indentations 159. Selected ones of the connectors 157 have a bent portion 141 which generally is sized and shaped to fit within the indentation 159. A connector with the bent portion is biased toward the rotary shaft 156, either by tension in the connector itself, or by spring underneath the connector 157 (not shown). In the position of the rotary shaft 156 shown in FIG, 7*a,* the lobe pushes the bent portion 141 down, and disengages this connector 157 from its mating connector 157. Further rotation of the shaft 156 aligns the indentation 159 with the bent portion 141, allowing the connector 157 to rise and engage with its mating connector 157, thereby coupling the respectively input and output terminals coupled to the connectors 157.

Accordingly, as can be seen from the various embodiments, the rotary shaft and the contact mechanisms of the present invention are susceptible to many different embodiments, which produce the benefits and features of the invention. Accordingly, the present invention encompasses any rotary shaft having contact mechanisms which electromechanically engage or disengage selected, predetermined electrically connectors in response rotation of the rotary shaft.

We claim:

1. An apparatus for arbitrarily electrically connecting m input terminals to n different output terminals comprising:

first assembly housing m input terminals and n output terminals;

a plurality of electrical connectors for either engaging to connect electrically or disengaging to disconnect electrically a number of the input terminals with a number of the output terminals; and a second assembly having an opening and housing a rotary shaft having a longitudinal axis and a plurality of angular positions of rotation about the axis, at least two of the angular positions each presenting one or more contact mechanisms which engage or disengage selected ones of the electrical connectors, and at least one position in which the rotary shaft may be removed from the apparatus without disassembly of the apparatus by movement of the rotary shaft along its axis and through the opening of the second assembly, wherein a different rotary shaft may be installed in the second assembly through the opening.

2. The apparatus of claim 1 wherein the contact mechanisms are lobes.

3. The apparatus of claim 1 wherein the contact mechanisms are electrically conductive materials disposed about a perimeter of the rotary shaft.

4. The apparatus of claim 1 wherein the contact mechanisms are indentations in a perimeter of the rotary shaft, selected ones of the electrical connectors include a bent portion shaped to correspond to the indentations, and angular rotation of the shaft to align one of the indentations with the bent portion of a connector engages the connector with a separate connector, thereby electrically coupling the input and output terminals.

5. The apparatus of claim 1 wherein each of the m input terminals is electrically connected to n electrical connectors, each of which can be electrically connected with or disconnected from one of the n output terminals.

6. The apparatus of claim 5 wherein the electrical connectors are arranged sequentially parallel to the rotary shaft, and the contact mechanisms are disposed at selected locations corresponding to the electrical connectors, so that a number of the electrical connectors can be selectively engaged or disengaged by corresponding contact mechanisms on the rotary shaft.

7. The apparatus of claim 1 wherein the input terminals and output terminals are for connection to a telephone headset and a telephone handset port, and different positions of the shaft correspond to different handset port wiring configurations.

8. An apparatus for arbitrarily electrically connecting m input terminals to n output terminals comprising:

an assembly housing m input terminals and n output terminals, and having an opening; and a rotary dial having a longitudinal axis and a plurality of angular positions of rotation about the axis, housed in the assembly, that has a plurality of electrically conducting paths runing from positions on the perimeter of the dial to other positions on the perimeter, for selectively electrically connecting or disconnecting one or more of the input terminals with one or more of the output terminals, depending on dial position, the rotary dial having at least one position in which it may be removed from the assembly without disassembly of the assembly, by movement of the rotary dial along its axis and out through the opening, wherein a different rotary dial may be installed into the assembly through the opening.

9. An apparatus for arbitrarily electrically connecting m input terminals to n output terminals comprising:

an assembly housing m input terminals and n output terminals, and having an opening;

a plurality of electrical connectors for either engaging to connect electrically or disengaging to disconnect electrically a number of the input terminals with a number of the output terminals; and a rotary dial, having a longitudinal axis and a plurality of angular positions of rotation about the axis, and housed in the assembly, having on its circumference a plurality of lobes for selectively engaging or disengaging the electrical connectors, depending on position, the rotary dial having at least one position in which it may be removed from the assembly without disassembly of the assembly, by movement of the rotary dial along its axis and through the opening, wherein a different rotary dial may be installed into the assembly through the opening.

10. In a telephone headset adapter that couples a telephone headset to a telephone handset port, the adapter including a first assembly housing input terminals and output terminals, a plurality of electrical connectors for either engaging to connect electrically or disengaging to disconnect electrically a number of the input terminals with a number of the output terminals, a second assembly having an opening, and a first rotary shaft housed in the second assembly and having a longitudinal axis and a plurality of angular positions of rotation about the axis, at least two of the angular positions each presenting one or more contact mechanisms which engage or disengage selected ones of the electrical connectors, wherein different angular positions of the first rotary shaft correspond to different handset port wiring configurations, and wherein the contact mechanisms of the first rotary shaft provides a first set of port wiring configurations, a method of modifying the adapter to provide a second set of port wiring configurations, the method comprising:

rotating the first rotary shaft to a position in which the contact mechanisms disengage the input terminals from the output terminals;

removing the first rotary shaft through the opening in the second assembly, without disassembling the telephone headset adapter; and inserting a second rotary shaft through the opening in the second assembly, without removing the second assembly, the second rotary shaft having contact mechanisms which provide the second set of port wiring configurations, the second set of port wiring configurations including at least one port wiring configuration that is different from the port wiring configurations of the first set.

11. An apparatus for arbitrarily electrically connecting m input terminals to n different output terminals comprising:

a first assembly housing m input terminals and n output terminals;

a plurality of electrical connectors for either engaging to connect electrically or disengaging to disconnect electrically a number of the input terminals with a number of the output terminals; and a second assembly housing a rotary shaft having plurality of angular positions and having one or more contact mechanisms which engage or disengage selected ones of the electrical connectors, depending on the angular position of the shaft, wherein the second assembly housing the rotary shaft is of monolithic construction, comprising two parts attached by at least one hinge, which parts close about the at least one hinge to form the second assembly.

* * * * *